US007125372B1

(12) United States Patent
Teeter et al.

(10) Patent No.: US 7,125,372 B1
(45) Date of Patent: Oct. 24, 2006

(54) TILTABLE EXERCISER HAVING FIXED CONTROL DEVICE

(76) Inventors: Roger C. Teeter, 20720 Snag Island Dr., Sumner, WA (US) 98390; Lo Pin Wang, 16F-2, No. 17, Lane 52, Sec. 3, Rehe Road, Beitun Chu, Taichung 406 (TW)

( * ) Notice: Subject to any disclaimer, the term of this patent is extended or adjusted under 35 U.S.C. 154(b) by 29 days.

(21) Appl. No.: 10/963,120

(22) Filed: Oct. 12, 2004

(51) Int. Cl.
*A63B 26/00* (2006.01)

(52) U.S. Cl. ..... 482/144; 482/145

(58) Field of Classification Search ..... 482/144–145; D21/688–89
See application file for complete search history.

(56) References Cited

U.S. PATENT DOCUMENTS 5,575,745 A 11/1996 Lin ..... 482/144
5,885,197 A * 3/1999 Barton ..... 482/144
6,637,055 B1 * 10/2003 Nanan ..... 5/610
2004/0157714 A1 * 8/2004 Huang ..... 482/144

* cited by examiner

*Primary Examiner*—Lori Amerson
(74) *Attorney, Agent, or Firm*—Charles E. Baxley

(57) ABSTRACT

A tilting inversion exerciser includes a stand, and a table rotatably attached to the stand with the shaft, to support a user. The table includes one or more hand grips for being grasped by the user, a driving device attached to the table and coupled to the shaft, to drive and rotate the table relative to the stand. A control device is attached to the hand grip, for being readily operated by the user, to control the driving device, and for preventing the control device from being disengaged from the hand grip and the table. The control device includes an electric cable coupled to the driving device, to operate the driving device. The electric cable may be engaged through the hand grip.

4 Claims, 3 Drawing Sheets

TILTABLE EXERCISER HAVING FIXED CONTROL DEVICE

BACKGROUND OF THE INVENTION

1. Field of the Invention

The present invention relates to a tiltable or a tilting inversion exerciser, and more particularly to a tilting inversion exerciser having a fixed control device for preventing the fixed control device from being separated from users, and for allowing the fixed control device to be easily operated by the users.

2. Description of the Prior Art

Various kinds of typical inversion suspension exercisers, rotational exercisers, tilting inversion exercisers etc. have been developed and comprise a table rotatably or pivotally attached to a support, and rotatable relative to the support for conducting various inversion or suspension exercises.

For example, U.S. Pat. No. 5,575,745 to Lin discloses one of the typical inversion suspension exercisers, and comprises a rotatational frame pivotally attached to a support with pivots, for allowing the users to rotate the frame relative to the support.

However, the typical inversion suspension exercisers do not have any control device to control the rotational movement of the frame relative to the support, such that the users may have to use their own weight and their strength to operate the conventional tilting inversion exercisers and to conduct the typical rotational or inversion exercises.

For allowing the users to easily operate the typical rotational or inversion exercises, the other typical rotational or inversion exercises have been developed and comprise a motor driving mechanism attached to the support, to control the table or the frame to rotate relative to the support, and thus to allow the users to easily operate the conventional tilting inversion exercisers.

For example, as shown in FIG. 1, illustrated is another tilting inversion exerciser which also comprises a table 20 rotatably or pivotally attached to a support 11, and rotatable relative to the support 11 for conducting various inversion or suspension exercises, and a motor driving mechanism 90 has further be provided and attached to the support 11, to control and to actuate the table 20 to rotate relative to the support 11.

In order to control the motor driving mechanism 90, a control box or member 91 is required to be provided and loosely coupled to the motor driving mechanism 90 with an electric cable 92, to allow the users to operate the conventional tilting inversion exercisers. However, the electric cable 92 may not be fixed to the support 11 or the table 20 due to the rotational movement of the table 20 relative to the support 11, and may thus be dropped or separated from the users, and may be wound around the support 11 or even the users inadvertently.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a fixed control device for preventing the fixed control device from being separated from users, and for allowing the fixed control device to be easily operated by the users.

In accordance with one aspect of the invention, there is provided a tilting inversion exerciser comprising a stand, a table rotatably attached to the stand with the shaft, to support a user, and the table including at least one hand grip for being grasped by the user, a driving device attached to the table and coupled to the shaft, to drive and rotate the table relative to the stand, and a control device attached to the hand grip, for being readily operated by the user, to control the driving device, and for preventing the control device from being disengaged from the hand grip and the table.

The control device includes an electric cable coupled to the driving device, to operate the driving device. The electric cable is engaged through the hand grip. The table includes at least one frame disposed thereon, and the hand grip is extended from the frame.

The electric cable is engaged through the hand grip and the frame. The table includes a foot retaining device attached thereto, to retain feet of the user to the table.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
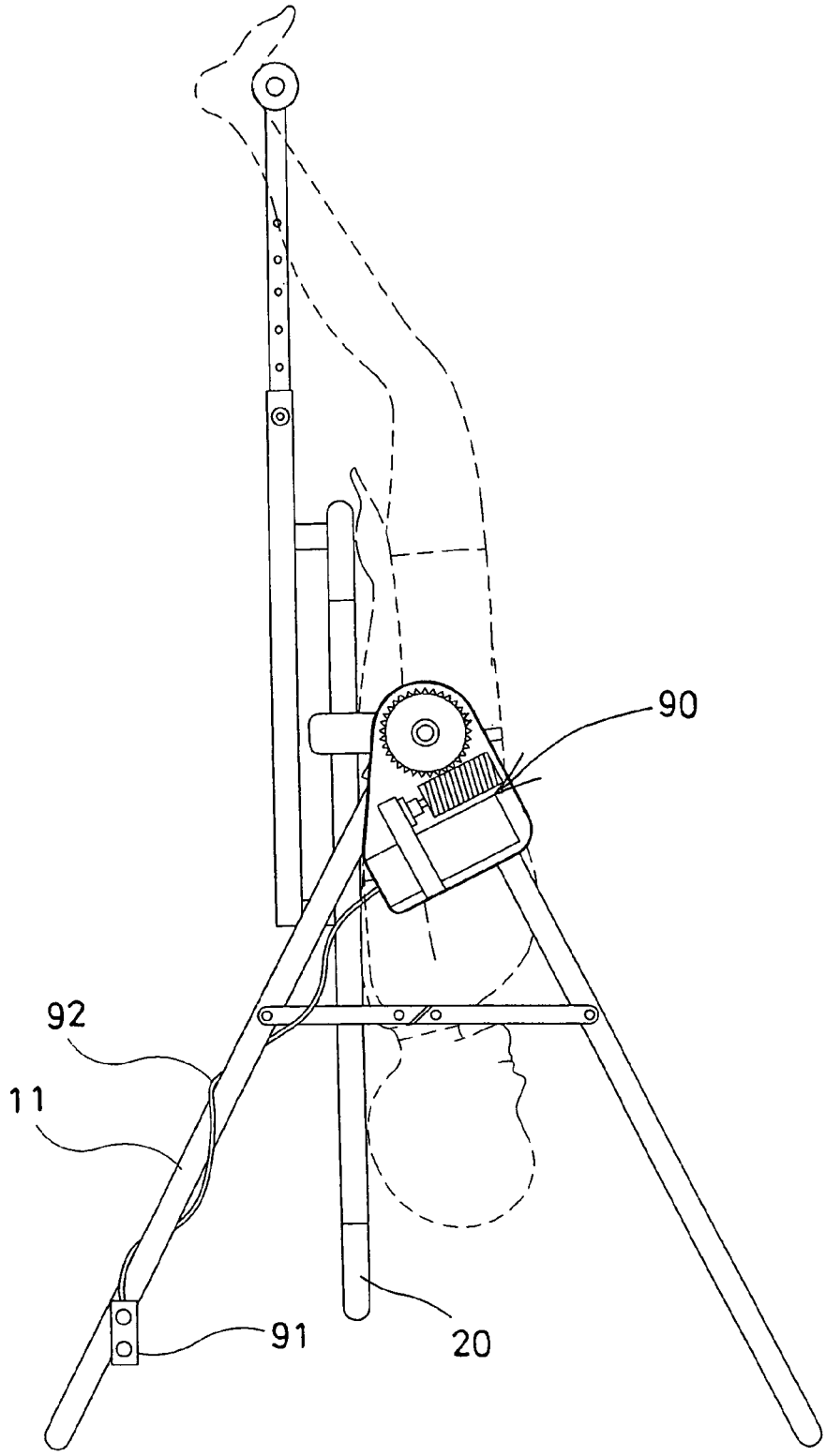
FIG. 1 PRIOR ART
FIG. 1 is a side plan view illustrating one of the typical tilting inversion exercisers.
Figure 2:
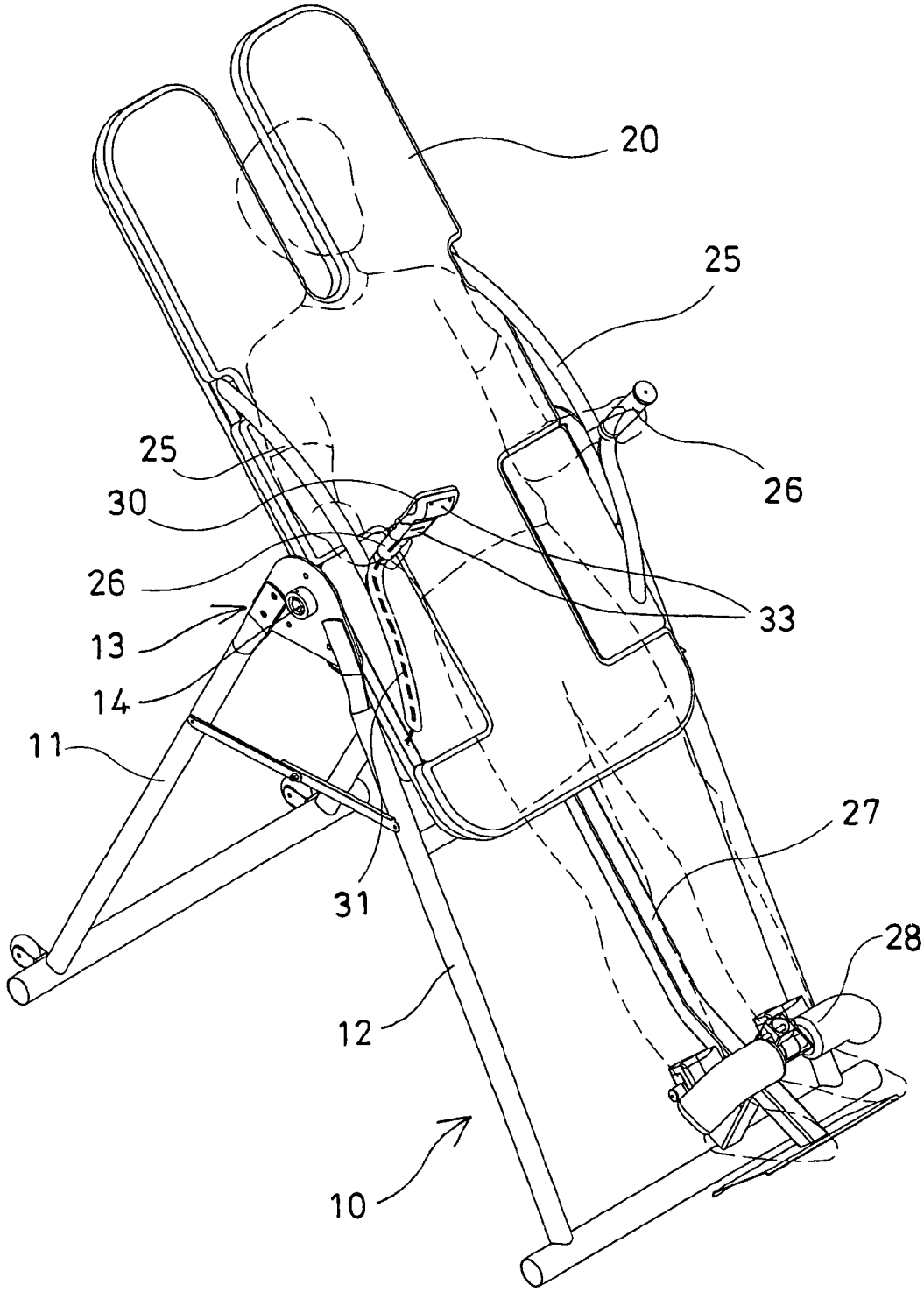
FIG. 2 is an upper perspective view of a tilting inversion exerciser in accordance with the present invention.
Figure 3:
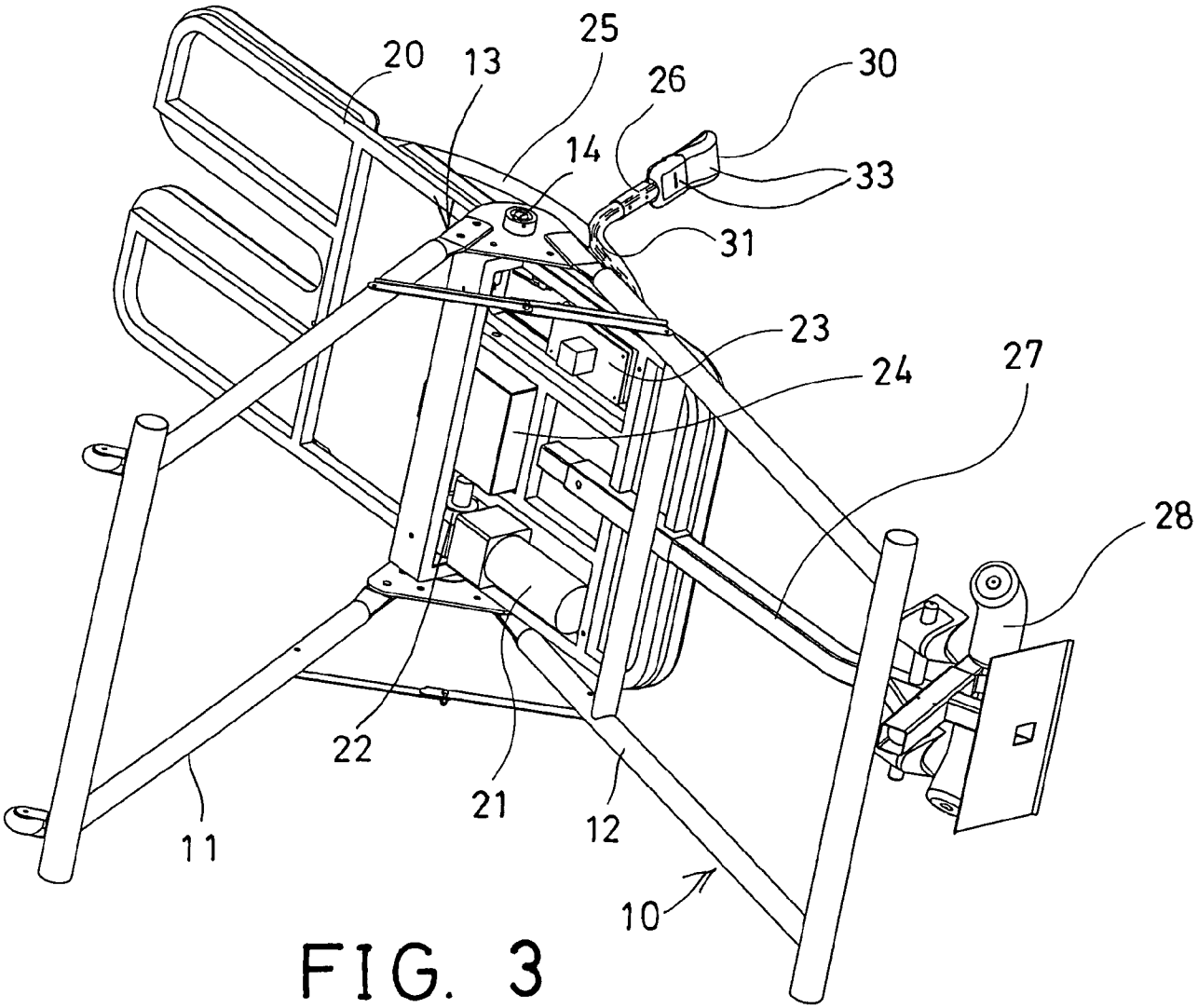
FIG. 3 is a bottom perspective view of the tilting inversion exerciser.

Referring to FIGS. 1 and 2, a tilting inversion exerciser in accordance with the present invention comprises a stand 10 including two frames 11, 12 pivotally attached together, and openable or movable relative to each other between an open or working position (FIGS. 1–2), and a folding or receiving position (not shown). The foldable stand 10 is typical and will not be described in further details.

A table 20 is rotatably or pivotally attached to an upper portion 13 of the stand 10 with a pivot shaft 14 or fasteners or the like, for allowing the table 20 to be rotated relative to the stand 10 with or about the pivot shaft 14. A driving device 21, such as a motor 21 is attached to the table 20, and includes a coupling or transmission device 22 coupled to or engaged with the shaft 14, in order to drive or to rotate the table 20 relative to the stand 10 about the pivot shaft 14.

The coupling or transmission device 22 may be any typical gearing transmission mechanisms, sprocket-and-chain coupling devices, pulley-and-belt coupling devices, bolt-and-worm transmission mechanisms, etc., for allowing the table 20 to be rotated relative to the stand 10 by the motor 21 via the coupling or transmission device 22. It is preferable that the table 20 may be rotated or driven by the motor 21 in either positive or opposite direction.

The table 20 may further include an electric control unit or box 23 attached thereto, and coupled to the motor 21, for controlling the motor 21, and one or more batteries 24 attached thereto, and coupled to the motor 21 and/or the electric control box 23, for controlling the motor 21 and/or the electric control box 23. The table 20 may further include one or more handles or frames 25 disposed thereon for being grasped by the users, or for retaining the users on the table 20, or the like.

The table 20 further includes one or more, such as two hand grips 26 disposed thereon, and directly extended therefrom, or indirectly extended from the frames 25 respectively, for being grasped by the users (FIG. 2). The table 20 may further include a foot retaining device 28 attached or coupled thereto with an adjustable extension 27, for holding or retaining or positioning the feet of the users to the table 20.

A control device 30 is attached or secured to one of the hand grips 26, and coupled to the electric control box 23 and/or the motor 21, with an electric cable 31, or via remote control mechanisms, for allowing the users to easily operate or control the electric control box 23 and/or the motor 21 to rotate or to drive the table 20 relative to the stand 10. The control device 30 may include one or more buttons 33 for being depressed or controlled by the users.

It is to be noted that the control device 30 is solidly attached or secured to one of the hand grips 26, and will not be disengaged or separated from the hand grip 26, such that the control device 30 may be easily operated by the users. The electric cable 31 may be engaged through the hand grip 26 and/or the frame 25, and may thus be suitably shielded, without being exposed. The electric control box 23 and/or the motor 21 may be controlled by the control device 30 via the electric cable 31, or via the typical remote control mechanisms.

In operation, as shown in FIG. 2, the user may be stably supported on the table 20, and the feet of the user may be retained or fixed in place by the foot retaining device 28. The users may hold or grasp the hand grips 26, and may easily actuate the control device 30 to rotate or to drive the table 20 relative to the stand 10. The control device 30 has no chance to be disengaged from the hand grips 26 and the table 20, and thus will have no chance to be separated from the users.

Accordingly, the tilting inversion exerciser in accordance with the present invention includes a fixed control device for preventing the fixed control device from being separated from users, and for allowing the fixed control device to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser comprising:

a stand, a table rotatably attached to said stand with said shaft, to support a user, and said table including at least one hand grip for being grasped by the user, a driving device attached to said table and coupled to said shaft, to drive and rotate said table relative to said stand, and a control device attached to said hand grip, for being readily operated by the user, to control said driving device, and for preventing said control device from being disengaged from said hand grip and said table, said control device including an electric cable coupled to said driving device, to operate said driving device, and said electric cable being engaged through said at least one hand grip for being shielded by said at least one hand grip and for being prevented from being exposed.

2. The tilting inversion exerciser as claimed in claim 1, wherein said table includes at least one frame disposed thereon, and said at least one hand grip is extended from said at least one frame.

3. The tilting inversion exerciser as claimed in claim 2, wherein said electric cable is engaged through said at least one hand grip and said at least one frame.

4. The tilting inversion exerciser as claimed in claim 1, wherein said table includes a foot retaining device attached thereto, to retain feet of the user to said table.

* * * * *